United States Patent [19]

Fuchs

[11] Patent Number: 5,036,626

[45] Date of Patent: Aug. 6, 1991

[54] KNIFE SHARPENING MACHINE WITH FORCE RELIEF MEANS

[76] Inventor: Richard W. Fuchs, 17 Deerfield La., Simsbury, Conn. 06070

[21] Appl. No.: 595,548

[22] Filed: Oct. 11, 1990

[51] Int. Cl.[5] ..... B24B 21/00

[52] U.S. Cl. ..... 51/135 R; 51/137; 51/215 UE

[58] Field of Search ..... 51/135 R, 84 BS, 98 BS, 51/109 BS, 137, 285, 238 T, 268, 274, 241 G, 215 UE

[56] References Cited

U.S. PATENT DOCUMENTS

| | | | |
|---|---|---|---|
| 2,375,604 | 5/1945 | Williams | 51/135 R |
| 2,852,895 | 9/1958 | Lamison | 51/135 R |
| 3,488,889 | 1/1970 | McCay | 51/135 R |
| 4,043,082 | 8/1977 | Ferroglio | 51/135 R |

*Primary Examiner*—Maurina Rachuba

*Attorney, Agent, or Firm*—McCormick, Paulding & Huber

[57] ABSTRACT

A machine for sharpening knives or similar cutting tools includes an endless abrasive belt and a tool engaging structure for supporting and guiding a tool into proper engagement with the belt. The tool engaging structure is located adjacent a portion of the belt path at which the belt is unsupported from behind so that as the tool is pushed against the belt the belt deflects inwardly. Damage to the tool and/or belt due to too large a force being applied between the tool and the belt is avoided by a pivotal unloader means which engages the tool and moves it away from the belt if an attempt is made to push the tool too far inwardly.

20 Claims, 2 Drawing Sheets

KNIFE SHARPENING MACHINE WITH FORCE RELIEF MEANS

BACKGROUND OF THE INVENTION

This invention relates to machines for sharpening knives and similar cutting tools, and deals more particularly with such a machine utilizing an endless belt.

Belt type abrading machines of the type having an abrasive belt and means for supporting and driving the belt along an endless path are well known, and it is also well known to use such machines for sharpening knives and other tools having elongated cutting edges. For a knife or the like to be optimally sharpened with such machines the edge must engage the abrasive belt at an appropriate angle and with an appropriate amount of force. During the sharpening procedure heat is generated at and near the area of co-engagement in rough proportion to the force existing between the edge and the abrasive belt. If the force is too great the edge becomes too hot and the resulting change in the microstructure of the knife material makes it less tough and less able to keep a keen edge, and the belt wears rapidly. On the other hand, if the force is too little the sharpening procedure may require an undue amount of time. Also, for best cutting results the two surfaces of the knife which meet to form the cutting edge should have an angle relative to one another falling within a narrow range, making the position of the knife relative to the belt quite critical.

To aid in the proper positioning of and the application of proper force to a knife being sharpened it is known to use a rest having a guide surface inclined to the path of travel of the belt and to mark, usually by trial and error, an index mark on the surface indicating the point to which a knife is to be moved for sharpening. However, this does not preclude the possibility of the knife being accidentally or intentionally moved beyond the index mark and creating overheating and other problems.

It is therefore the object of the present invention to provide a simple, easy-to-use and inexpensive machine for sharpening knives and other cutting tools which provides for the proper positioning of the tool relative to the abrasive belt and which also provides a relief mechanism assuring that a tool cannot be advanced into the belt too far or with too much force during a sharpening process.

Other objects and advantages will be apparent from the following description of a preferred embodiment of the invention and from the accompanying drawings and claims.

DETAILED DESCRIPTION OF THE PREFERRED EMBODIMENTS

Figure 3:
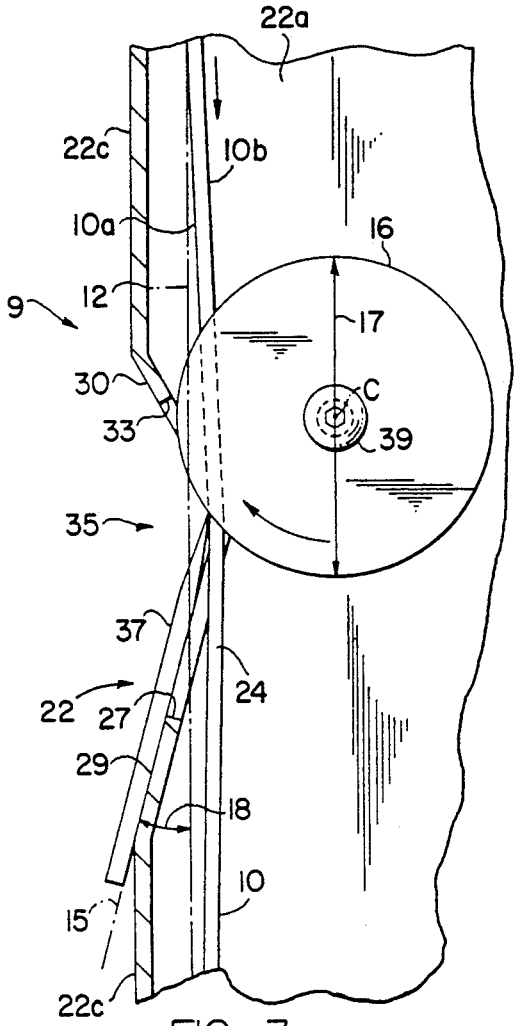
FIG. 3 is a fragmentary vertical sectional view, taken in the line 3—3 of FIG. 1, showing in detail how the endless belt deflects inwardly during a sharpening processs.
Figure 1:
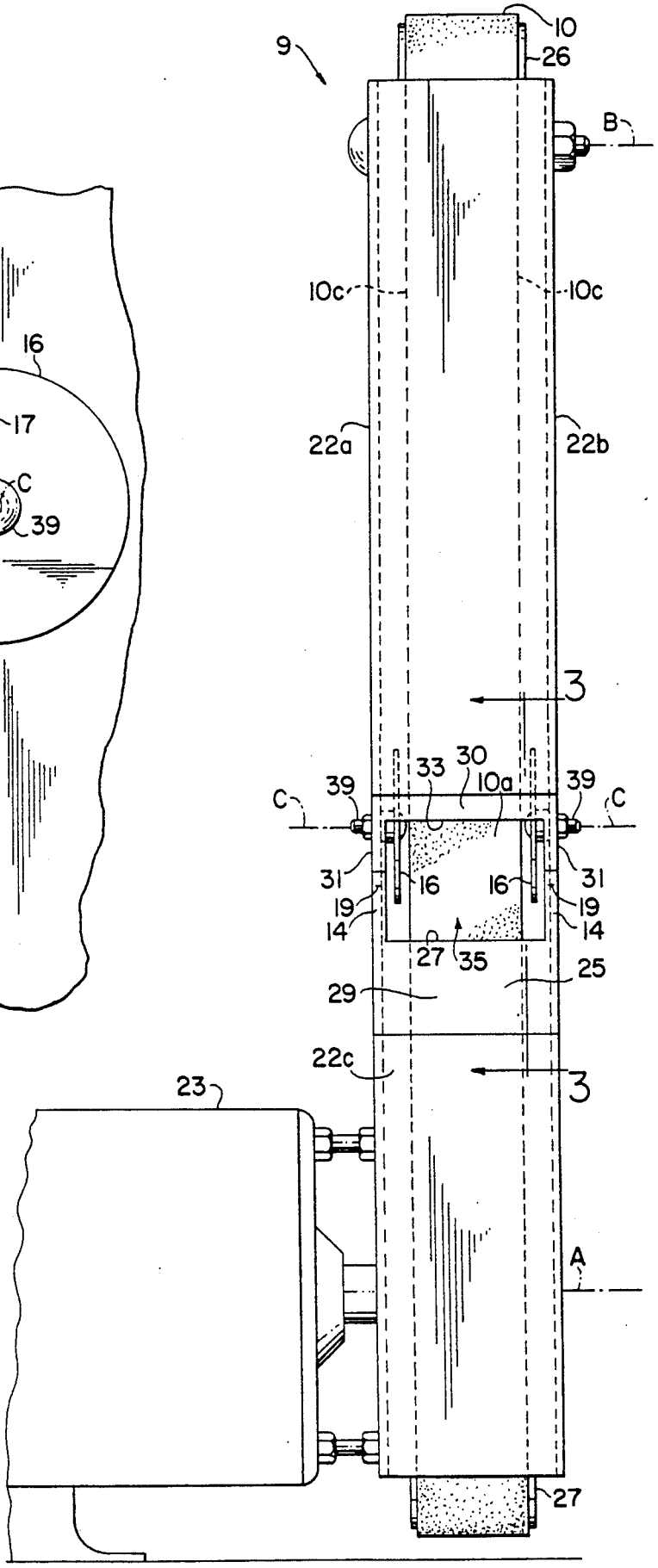
FIG. 1 is a front view of a knife sharpening machine embodying the invention.
Figure 2:
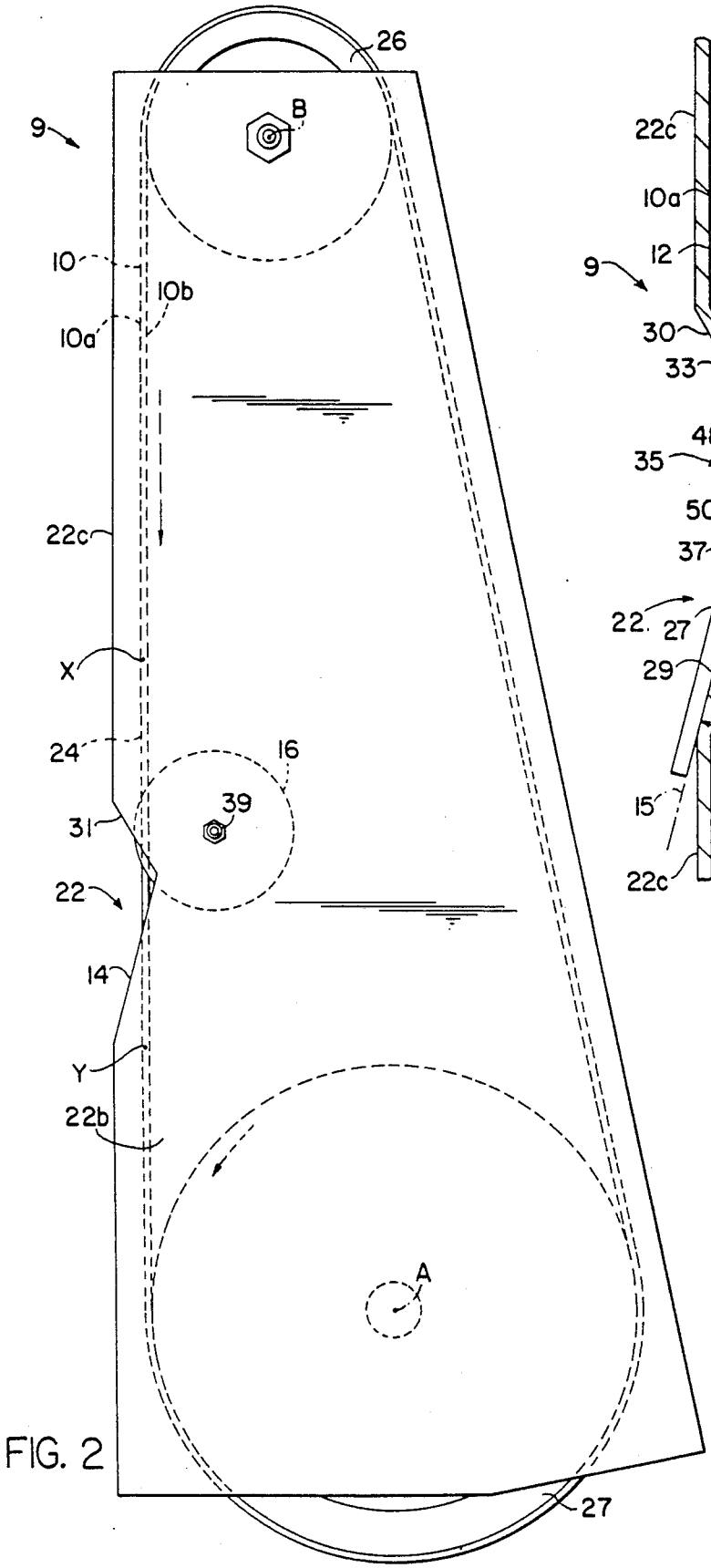
FIG. 2 is a side elevational view of the machine of FIG. 1 showing the endless belt, pulleys and one of a pair of unloader disks.

Turning to the drawings, FIGS. 1 to 3 illustrate a belt type abrading machine, indicated generally at 9, for sharpening knives and other cutting tools having at least one elongated edge. The machine comprises generally an endless belt 10, means for supporting and driving the belt along an endless path, a tool engaging structure 22 located along a portion of the path along which the belt is unsupported from behind itself, and a pair of rotatably supported unloader disks 16 also located adjacent the same portion of the path.

The endless belt 10 is of the type having an outer abrasive surface 10*a*, an inner surface 10*b* and two side edges 10*c*; and it travels in an endless path around a pair of pulleys consisting of an upper pulley 26 and a lower pulley 27. The outer abrasive surface 10*a* faces outwardly from the path and the inner surface 10*b* faces inwardly. The pulleys are supported for rotation about axes A and B, respectively, with the lower pulley 27 being driven by a power source which may comprise, for example, an electric motor 23. The upper pulley 26 is an idler pulley.

The pulleys 26, 27 and belt 10 are contained in a housing including side walls 22*a*, 22*b* extending vertically between the pulleys 26, 27, with each of the two side walls 22*a*, 22*b* being positioned adjacent a respective one of the sides of the pulleys. Between the two side walls is a front wall 22*c* located in front of the belt 10.

As shown in FIGS. 1 and 2, a point located on the belt 10 travels down the front of the machine, under the driven lower pulley 27, up behind the machine, and over the upper idler pulley 26 to return down the front of the machine. As viewed in FIG. 2, the pulleys 26, 27 and the endless belt 10 travel in a counterclockwise direction.

Along the path travelled by the belt 10 is a portion 24 extending between two points, indicated generally in FIG. 2 as X and Y, along which the belt 10 is unsupported adjacent its inner surface 10*b*. In the absence of an inwardly directed force being applied to the outer abrasive surface 10*a* along the unsupported portion 24 of the belt, the belt 10 is located in a neutral plane 12, as shown by the broken lines of FIG. 3. When an inwardly directed force is applied to the belt 10 between the points X and Y it deflects inwardly, as shown by the solid lines of FIG. 3.

The tool engaging structure 22 is comprised of portions of the housing side walls 22*a*, 22*b*, or like means, and of the front wall 22*c* located adjacent the unsupported portion 24 of the belt 10. Parts of this structure are tool guide surfaces 14 on the edges of the side walls 22*a*, 22*b* inclined to the belt and facing generally in the same direction as the outer abrasive surface 10*a*. Each guide surface 14 extends inwardly of and outwardly from the neutral belt plane 12, as shown in FIG. 3, to allow for movement of a knife or other tool inwardly toward and beyond and outwardly away from the belt's neutral plane.

The guide surfaces 14 are positioned generally parallel to one another so as to lie in a common guide surface plane 15, which guide surface plane 15 is inclined at an angle 18 relative to the neutral plane 12. While the neutral plane 12 and guide surface plane 15 may be oriented to intersect at various angles, the elongated edges of many, if not most, cutting tools are properly sharpened when the tool and abrasive surface engage one another at an angle of between 10 and 20 degrees. FIG. 3 shows the guide surface plane 15 intersecting the neutral plane 12 at an angle of approximately 15 degrees. The guide surface plane 15 and the neutral plane 12 further intersect one another in a straight line extending generally transversely of and parallel to the front surface 10*a* of the belt.

As shown in FIG. 1, in the preferred and illustrated embodiment an additional optional guide surface 29 is provided which is coplanar with the edge guide surfaces 14 and which additional guide surface 29 is formed by an inclined portion 25 of the outer housing wall 22*c*. The inclined wall portion 25 extends between the side walls 22*a* and 22*b* and terminates at a transverse edge 27 located close to the belt neutral plane 12.

Above the guide surfaces 14, as seen in FIG. 1, the tool engaging structure also includes an inwardly inclined portion 30 of the front wall 22*c* and coplanar inclined edges 31 on the side walls. The wall portion 30 terminates in a transverse edge 33 located close to the belt neutral plane 12. Therefore, the transverse edges 27 and 33 and the side wall edge portions 14 and 31 define a window 35 providing access to the belt 10 by a tool 37 rested on the guide surfaces 14 and 29, as shown in FIG. 3.

Each guide surface 14 is provided with a visible index mark 19 located inwardly of the line of intersection between the belt neutral plane 12 and guide surface 15. When a knife or other elongated tool 37 is held against the guide surfaces 14 it should be moved inwardly against the belt until its edge is aligned with the index marks 19. The index marks 19 are in turn so positioned on the surfaces 14 that when a tool edge is aligned with them the tool is positioned to engage the belt with the appropriate force.

It is however possible that despite the existence of the index marks a tool might be moved inwardly beyond the marks and into engagement with the belt with too much force. To prevent this from happening the tool engaging structure 22 also includes a pair of unloader disks 16 located adjacent to and outboard of the side edges 10*c* of the belt 10 and carried by the housing side walls 22*a* and 22*b* or like means. Each unloader disk 16 is supported for rotation relative to its associated side wall about a common axis C extending transversely to the path of the belt 10.

Each unloader disk 16 is relatively thin, is substantially flat, is generally circular in shape, has a diameter 17 and has a central aperture through which a supporting stud 39 passes as shown in FIG. 2. These disks 16 may be made of metal, but preferably are made of plastic so as to avoid damage to the edge of a tool which may come into engagement with them. The diameters 17 of the unloader disks 16 are large enough and their positions on the side walls are such that as a tool is pushed inwardly toward the belt, at the point at which the force between the belt and the tool is on the verge of becoming too great, the edge of the tool will engage the outer edges of the disks 16. Further forward movement of the tool then causes the unloader disks 16 to rotate (clockwise in FIG. 3) to carry the tool edge outwardly, thereby reducing the belt deflection and relieving the force with which the tool edge engages the belt 10. In the illustrated case, as shown in FIG. 3, the unloader disks 16 have a common diameter 17 which is greater than the perpendicular distance from their common axis C to the first plane 12, but less than the perpendicular distance from the common axis C to the line formed by the intersection of the neutral plane 12 and the guide surface plane 15. Further, the common axis C is positioned inwardly of the neutral plane 12 and forwardly from the intersection line of the neutral plane 12 and the guide surface plane 15.

In the machine 9 described above the tool engaging structure is such as to provide inclined guide surfaces having a fixed angle relative to the adjacent portion of the belt path; however it is to be understood that it is within the scope of the invention to also make the tool supporting structure in such a way that the guide surface or surfaces is or are adjustable with regard to the angle relative to the adjacent belt path so as to allow an operator to set the guide surface or surfaces at any selected angle within an available range of angles.

Figure 4:
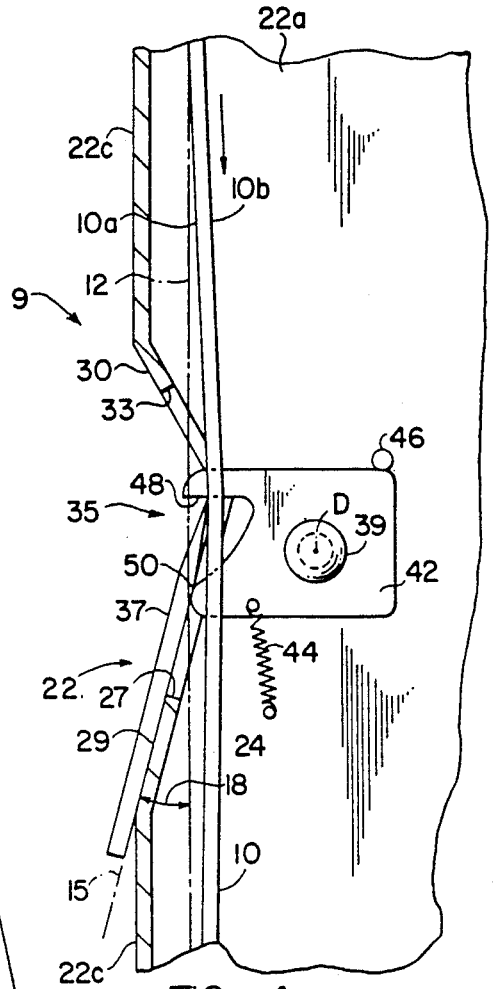
FIG. 4 is a view similar to FIG. 3 but showing a knife sharpening machine comprising another embodiment of the invention.

In the machine 9 described above the unloader disks 16 function as a means pivotal about an axis extending transversely of the path of belt travel, which means is engagable by the edge of a knife or other tool being sharpened in the event the tool is fed too far into the belt, and which means upon further advancement of the tool following such engagement pivots about said transverse axis and in doing so moves the edge of the tool in the direction away from the belt. It is within the scope of the invention that members or means other than specifically the disks 16 of FIGS. 1 to 3 may be used to serve this purpose; and an example of such other means is shown in FIG. 4. Referring to FIG. 4, in the machine illustrated each of the unloader disks 16 of FIGS. 1 to 3 is replaced by an unloader member 42, of metal or preferably plastic, supported by the associated housing side wall 22*a*, or similar means, by a stud 39 for rotation about an axis D extending transversely of the path of the belt 10. Each member 42 is biased in the counterclockwise direction, as seen in FIG. 4, about the axis D by a light tension spring 44 connected between it and the side wall 22*a*, and it is held in the illustrated full line position of FIG. 4 by a stop 46 fixed to the side wall 22*a*. When the illustrated knife 37 is advanced too far into the belt 10 it will engage a first surface 48 of the member 42 causing the member 42, upon still further advancement of the knife, to rotate clockwise about the axis D. This rotation in turn causes a second surface 50 of the member 42 to engage the knife rearwardly of its edge and to move the knife in the direction away from the belt.

I claim:

1. A belt type abrading machine for sharpening knives and other cutting tools having at least one elongated edge, said machine comprising:

an endless belt having an outer abrasive surface, an inner surface and two side edges, means for supporting and driving said endless belt along a path which path includes a portion extending between two spaced points and located in a neutral plane when no inwardly directed forces are applied to said outer face of said endless belt along said path portion and along which path portion said belt is unsupported adjacent said inner face so that it can deflect inwardly from said neutral plane when an inwardly-directed force is applied to said outer abrasive surface, a tool engaging structure arranged along said belt path portion providing at least one guide surface located adjacent said portion of said belt path, said guide surface being inclined relative to said belt path portion so that as a tool with its edge facing inwardly is advanced inwardly along said guide surface from a position initially spaced outwardly of said belt path portion it eventually engages said outer face of said belt and deflects said belt inwardly, and an unloader means pivotable about an axis extending transversely to said belt path which means is engagable and rotatable about said transversely extending axis by a tool resting on said guide surface when said tool is advanced inwardly beyond a given point after engaging said outer surface of said belt and which means as a result of such rotation moves said tool in the direction away from said belt to relieve the inwardly directed force imposed by said tool on said belt.

2. A belt type abrading machine for sharpening knives and other cutting tools as defined in claim 1 further characterized by said unloading means being at least one generally circular unloader disk located adjacent to and outboard of one of said side edges of said belt and supported for rotation relative to said guide surface about an axis extending parallel to the intersection line of said neutral plane and said guide surface plane, said unloader disk being of such a diameter and being so located relative to said guide surface that after said edge of a tool moves inwardly beyond said neutral plane it eventually engages said unloader disk and upon still further inward movement of the tool it causes said disk to rotate and to return said edge of the tool toward said neutral plane.

3. A belt type abrading machine for sharpening knives and other tools as defined in claim 1 further characterized by said unloading means being at least one unloader member located outboard of one of said side edges of said belt and supported for rotation relative to said guide surface about an axis extending parallel to the intersection line of said neutral plane and said guide surface plane, said member having a first surface located so as to be engaged by said edge of a tool when said tool is advanced inwardly beyond said given point and a second surface which second surface as a result of the rotation of said member occurring as a result of said engagement of said tool edge with said first surface engages said tool rearwardly of said edge and moves said tool in the direction away from said belt.

4. A belt type abrading machine for sharpening knives and other cutting tools as described in claim 1 further characterized by said guide surface plane being at an angle of between 10 and 20 degrees to said neutral plane.

5. A belt type abrading machine for sharpening knives and other cutting tools as described in claim 1 further characterized by said guide surface plane being at an angle of about 15 degrees to said neutral plane.

6. A belt type abrading machine for sharpening knives and other cutting tools having at least one elongated edge as described in claim 1 further characterized by said guide surface having an index mark with which the edge of a tool may be aligned for proper sharpening.

7. A belt type abrading machine for sharpening knives and other cutting tools having at least one elongated edge as described in claim 2 further characterized by said unloader disk axis being spaced inwardly from said neutral plane by a first distance and also spaced forwardly from the intersection of said neutral plane and guide surface plane, said disk having a diameter greater than said first distance and less than the distance between said intersection and said common axis.

8. A belt type abrading machine for sharpening knives and other cutting tools having at least one elongated edge as described in claim 1 further characterized by said endless belt travelling in a direction generally opposite to the inward movement of said tool edge.

9. A belt type abrading machine for sharpening knives and other cutting tools having at least one elongated edge, said machine comprising:

an endless belt having an outer abrasive surface, an inner surface and two side edges, means for supporting and driving said endless belt along a path which path includes a portion extending between two spaced points and located in a neutral plane when no inwardly directed forces are applied to said outer face of said endless belt along said path portion and along which path portion said belt is unsupported adjacent said inner face so that it can deflect inwardly from said neutral plane when an inwardly-directed force is applied to said outer abrasive surface, a tool engaging structure arranged along said belt path portion providing two guide surfaces located respectively adjacent and outboard of said side edges of said belt and in a common guide surface plane inclined relative to said neutral plane, said guide surfaces being inclined relative to said belt path portion and extending both inwardly and outwardly of said belt path portion so that as a tool with its edge facing inwardly is moved inwardly along said guide surfaces from a position initially spaced outwardly of said belt path portion it eventually engages said outer face of said belt and deflects said belt inwardly, and a pair of unloader disks located respectively adjacent to and outboard of said side edges of said belt and supported for rotation relative to said guide surfaces about a common axis extending parallel to the intersection line of said neutral plane and said guide surface plane, said unloader disks being of such a diameter and being so located relative to said guide surfaces that after said edge of a tool moves inwardly beyond said neutral plane it eventually engages said unloader disks and upon still further inward movement of the tool it causes said disks to rotate and to return said edge of the tool toward said neutral plane to reduce the inwardly directed force imposed by said tool on said belt.

10. A belt type abrading machine for sharpening knives and other cutting tools as described in claim 9 further characterized by said guide surface plane being at an angle of between 10 and 20 degrees to said neutral plane.

11. A belt type abrading machine for sharpening knives and other cutting tools as described in claim 9 further characterized by said guide surface plane being at an angle of about 15 degrees to said neutral plane.

12. A belt type abrading machine for sharpening knives and other cutting tools having at least one elongated edge as described in claim 9 further characterized by said guide surfaces each having an index mark with which the edge of a tool may be aligned for proper sharpening.

13. A belt type abrading machine for sharpening knives and other cutting tools having at least one elongated edge described in claim 9 further characterized by said common axis being spaced inwardly from said neutral plane by a first distance and also spaced forwardly from the intersection of said neutral plane and guide surface plane, said disks having a common diameter greater than said first distance and less than the distance between said intersection and said common axis.

14. A belt type abrading machine for sharpening knives and other cutting tools having at least one elongated edge as described in claim 9 further characterized by said tool engaging structure including side walls located on either side of said belt path portion and an outer wall extending between side walls, said outer wall including an inclined portion providing an additional guide surface coplanar with said two guide surfaces.

15. A belt type abrading machine for sharpening knives and other cutting tools having at least one elongated edge as described in claim 9 further characterized by said endless belt travelling in a direction generally opposite to the inward movement of said tool edge.

16. A belt type abrading machine for sharpening knives and other cutting tools having at least one elongated edge, said machine comprising:

an endless belt having an outer abrasive surface, an inner surface and two side edges, means for supporting and driving said endless belt along a path which path includes a portion extending between two spaced points and located in a neutral plane when no inwardly directed forces are applied to said outer face of said endless belt along said path portion and along which path portion said belt is unsupported adjacent said inner face so that it can deflect inwardly from said neutral plane when an inwardly-directed force is applied to said outer abrasive surface, a tool engaging structure arranged along said belt path portion providing two guide surfaces located respectively adjacent and outboard of said side edges of said belt and in a common guide surface plane inclined relative to said neutral plane, said guide surfaces being inclined relative to said belt path portion and extending both inwardly and outwardly of said belt path portion so that as a tool with its edge facing inwardly is moved inwardly along said guide surfaces from a position initially spaced outwardly of said belt path portion it eventually engages said outer face of said belt and deflects said belt inwardly, and a pair of unloader members located respectively adjacent to an outboard of said side edges of said belt and supported for rotation relative to said guide surfaces about a common axis extending parallel to the intersection line of said neutral plane and said guide surface plane, said unloader members each having a first surface located so as to be eventually engaged by said edge of a tool as it moves inwardly beyond said neutral plane and also having a second surface which second surface as a result of the rotation of said unloader member which occurs as a result of said engagement of said tool edge with said first surface engages said tool rearwardly of said edge and moves said tool in the direction away from said belt.

17. A belt type abrading machine for sharpening knives and other cutting tools as described in claim 16 further characterized by said guide surface plane being at an angle of between 10 and 20 degrees to said neutral plane.

18. A belt type abrading machine for sharpening knives and other cutting tools as described in claim 16 further characterized by said guide surface plane being at an angle of about 15 degrees to said neutral plane.

19. A belt type abrading machine for sharpening knives and other cutting tools having at least one elongated edge as described in claim 16 further characterized by said guide surfaces each having an index mark with which the edge of a tool may be aligned for proper sharpening.

20. A belt type abrading machine for sharpening knives and other cutting tools having at least one elongated edge as described in claim 16 further characterized by said tool engaging structure including side walls located on either side of said belt path portion and an outer wall extending between side walls, said outer wall including an inclined portion providing an additional guide surface coplanar with said two guide surfaces.

* * * * *